United States Patent [19]

Jeromin

[11] Patent Number: 4,624,544

[45] Date of Patent: Nov. 25, 1986

[54] AUTOMATIC XEROGRAPHIC PLATE DEVELOPMENT SYSTEM

[75] Inventor: Lothar S. Jeromin, Sierra Madre, Calif.

[73] Assignee: Xerox Corporation, Stamford, Conn.

[21] Appl. No.: 800,876

[22] Filed: Nov. 22, 1985

[51] Int. Cl.[4] ..... G03G 15/00

[52] U.S. Cl. ..... 355/3 R; 355/10; 355/14 SH; 378/28; 378/37

[58] Field of Search ..... 355/3 R, 14 R, 14 SH, 355/3 SH, 3 TR, 14 TR, 10, 77; 430/966, 967; 378/28, 32, 33, 37; 250/315.3

[56] References Cited

U.S. PATENT DOCUMENTS

| | | | |
|---|---|---|---|
| 4,014,607 | 3/1977 | Cherian | 355/3 R |
| 4,118,116 | 10/1978 | Koontz et al. | 355/3 R |
| 4,346,983 | 8/1982 | Jeromin et al. | 355/3 R |
| 4,358,195 | 11/1982 | Kuehnle et al. | 355/10 |
| 4,394,085 | 7/1983 | Dennhardt | 355/14 SH X |
| 4,402,592 | 9/1983 | Schön et al. | 355/3 SH X |

*Primary Examiner*—A. C. Prescott
*Attorney, Agent, or Firm*—Robert E. Cunha

[57] ABSTRACT

An improved system for the automatic development of large xeroradiographic images. The system is arranged from left to right in the following order: the development station, the transfer station, the cleaning station, the input and output stations and the elevator. The transport system has two main levels, one to carry the exposed plate over the station to the left, the other to carry the plate through the stations to the right to develop an image. The top of the elevator serves as a relocation station and plates are stored in the bottom of the elevator. To save additional space, the development station moves to the left as the plate passes over it to the right.

5 Claims, 17 Drawing Figures

AUTOMATIC XEROGRAPHIC PLATE DEVELOPMENT SYSTEM

BACKGROUND OF THE INVENTION

This invention is an improved system for the automatic development of xeromamographs, and specifically is a more compact and convenient arrangement of stations within the development system.

A previous system for the automatic development of x-ray mammographs is described in issued U.S. Pat. No. 4,038,943. That system was sold commercially as Xerox Models 125 and 126 and required two units, a conditioning unit in which xerographic plates were stored and charged just prior to use, and a processing unit in which prints were made from the exposed plates.

It was thought that an improvement in the productivity of the operating technologist could be realized and a savings in floor space could be achieved by combining the two units into one compact unit.

An additional design goal was to have front access for all functions. That is, the consumable materials such as the toner components, the cleaning solvent and the paper as well as the imaged plates are all loaded into the unit from the front, the charged plates are delivered to the operator from the front panel, and the finished images are delivered to a front panel output tray. In addition, the CRT and keyboard which stand on the top surface of the unit should be conveniently operable by an operator standing in front of the unit.

Finally, the unit had to be serviced from the front. It would be more efficient if the operator could clear minor mechanical faults by accessing the unit through the front panel, and if the repairman would not have to move the unit away from the wall to perform most kinds of troubleshooting and repair.

SUMMARY OF THE INVENTION

These design objectives were accomplished by arranging the fountain, the development station, the image transfer station, the cleaning station, the input station and the plate storage area from left to right within one cabinet so that an exposed plate moving from left to right would be developed and stored in one passage through the system. The front panel has built-in output stations where the operator is supplied with charged casettes and finished images and an input station where the operator can insert exposed cassettes. In addition, the entire front panel opens to expose the frontal area of the system so that consumables may be added and so that maintenance and repair may be accomplished.

The length of the system was reduced by designing the system so that the development fountain travels to the left as the plate passes over it moving to the right. An elevator was designed into the storage area so that the upper part of the area serves as a relaxation station while the lower portion serves as a storage area. Finally, a terminal comprising a keyboard and CRT stand on the top surface of the cabinet to allow the operator to monitor and control system operation. The result is a compact system which allows the operator to work efficiently.

The system will be more clearly understood in relation to the following drawings.

FIGS. 4-1 through 4-4 are a side views of the plate carrier.

Figure 1:
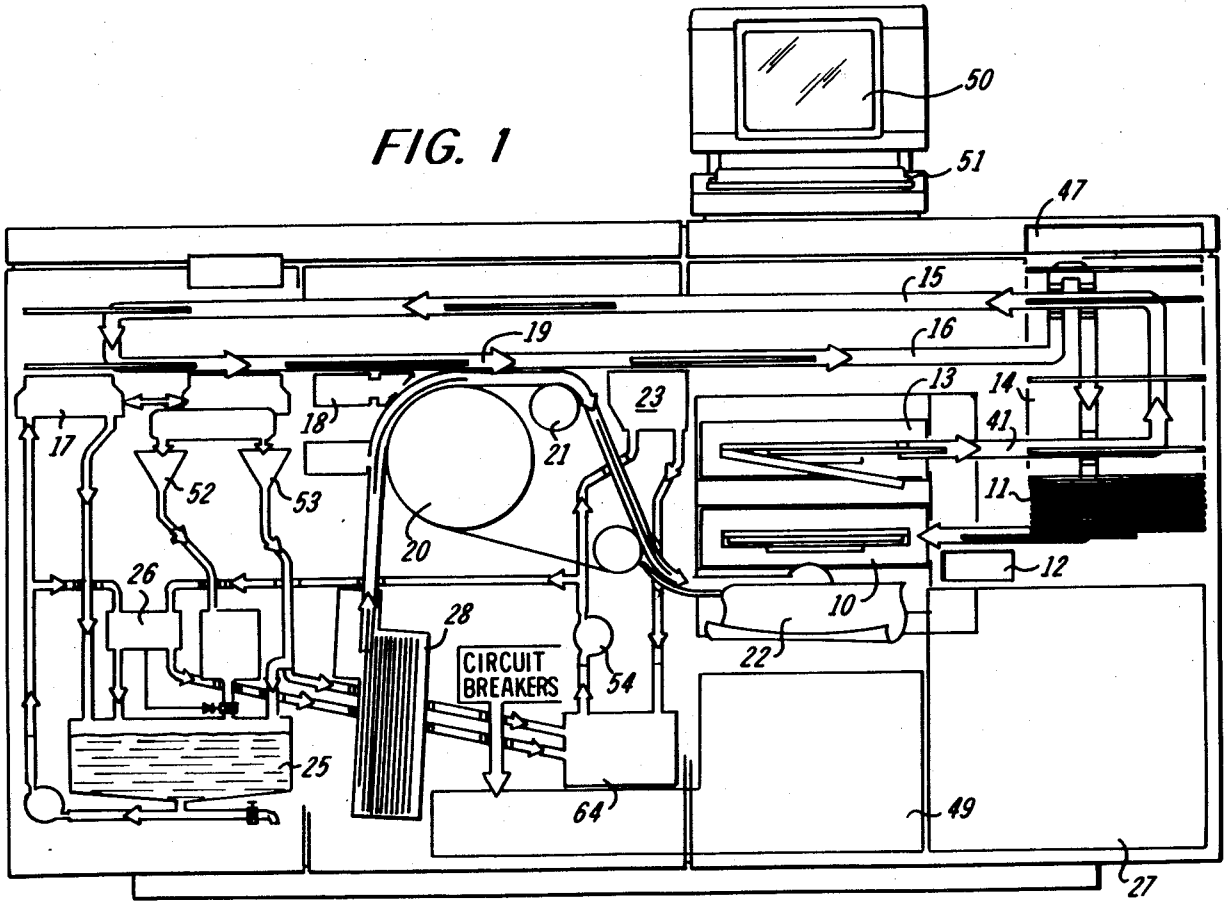
FIG. 1 is a simplified front view of the system.

The overall operation can best be described in relation to FIG. 1.

To generate and process an image, the operator will first insert an empty cassette into the cassette output station 10. The system then draws a xerographic plate from the bottom of the stack of plates in the plate storage area 11, charges it by passing it over the scorotron 12, inserts the charged plate into the empty cassette, closes the cassette and partially extends the cassette outward from the output station 10 so that the operator can remove it.

After the plate is exposed, the cassette will be placed by the operator into the input station 13 where the cassette is opened and the plate is withdrawn. The plate then travels the path shown by the broad arrows.

The first segment of the path is from the input station 13 to the elevator 14 which raises the plate to the upper track 15. Here the plate is transported to the left end of the system. The system was designed so that the speed of transport of the plate is fastest on the upper track to save time since no development functions take place at this level. At the left end of the track 15, the plate drops, by force of gravity, to the left end of the lower track 16.

The first station is the liquid toner fountain 17 which develops the image. As a means for reducing the length of the cabinet, the fountain and the plate both move during development. Prior to development, the fountain is positioned at the right end of its track and the plate drops down into a position at the left end of the lower track 16. Then the plate moves to the right and the fountain moves to the left at a controlled rate so that the fountain is at the left end of its travel at the time when the plate is completly developed. This technique reduces the length of the cabinet by the width of the fountain. At the end of development, the plate then continues on to the next station, and the fountain returns to its home position at the right end of its travel.

The next element in the development path is a precharge corotron 18. This adds more positive charge to the toner on the developed plate to provide for a more complete transfer of toner from the plate to the paper during the transfer step.

At the transfer station 19, a negative charge, opposite that of the toner, is applied to the back of the paper, to attract the toner from the plate to the paper. This charge is deposited onto the paper by the transfer corotron 20.

The next station is the drying station 21 where the toner on the paper is dried by the application of forced air. The fusing step in this embodiment employs self-fusing where the paper has a surface coating which reacts with the solvent in the toner to trap the toner particles.

Thus, the paper need only to be dried to complete the image making process. Finally, the finished image is dropped into the output tray 22 where it is available to the operator.

The plate will continue along the lower track 16 to the cleaning station 23 where foam rollers will remove the residual image. It then continues along the lower track 16 to the elevator 14 which raises the plate against a heating blanket in the relaxation station 25 for about 15 seconds which removes any residual charge (ghost image) that may remain in the selenium coating of the plate. The plate is then lowered onto the top of the stack of stored plates in the plate storage area 11.

At the same time several ancillary operations are being performed in the system. The density of the toner is continuously monitored by the density controller 26, and additional toner is automatically added to the toner reservoir 25 through the toner filler tube 52 and stored in sump 54 to be used as required. The total level of the suspension of toner and isopar is also measured, and if more isopar is required, an indication to the operator is initiated. Isopar is loaded at filler 53. The foam roller which is used to brush the residual toner from the plate is continuously cleaned by being rotated against a cleaning roller int the presence of a fresh supply of isopar, which, in turn, is continuously filtered to remove the solid particles.

The electronics 27 which control the logic functions are located below the elevator 14, and there is also a group of power supplies under the output tray 22.

A paper tray 28 contains 100 sheets of coated paper which must be replenished periodically. Here again, a sensor monitors the supply, and an indication is sent to the operator when there is a small supply remaining. There is also a light source on one side of the paper tray, and a light sensor on the other to sense a complete absence of paper in the tray 28. If there is no paper in the tray, the entire system is automatically disabled. To run the system through a cycle at a time when there is no paper would not only require the patient to be exposed to a second x-ray dosage, but would also damage the plate since a set of wipers which normally hold the paper against the plate would scratch the plate in the absence of an intervening layer of paper. To prevent these problems, if there is no paper, the cassette in the input station will not be opened so that the cabinet can be opened to replenish the paper without destroying the image on the plate.

A CRT 50 and keyboard 51 are used by the operator to communicate with the system. The isopar in the cleaning station reservoir 64 is used at the cleaning station 23 and at a small cleaner roll in the density controller 26. It is pumped to these places by pump 54 and its associated tubing as shown.

Figure 2:
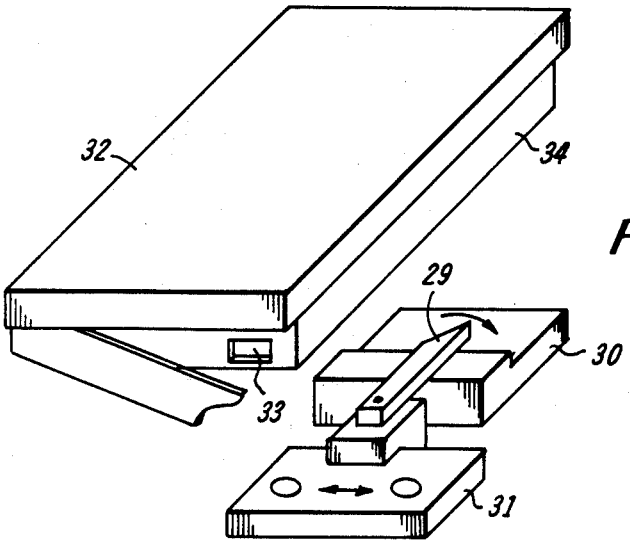
FIG. 2 is a simplified view of the mechanism for removing the plate from the cassette immediately after the cassette is inserted into the input station.

FIG. 2 shows some details of the input station. There is a chain drive on each side of the cassette, only one half of the system is shown here, terminating in a link 31, on which is mounted a finger 29 which can rotate a few degrees in the direction shown by the arrow, but which is normally biased into the position shown. When the casette is inserted into the input station, the cassette opens, exposing the slot 33 in the plate 34. The link advances to the left until the finger 29 engages the slot 33. Then the link 31 reverses direction, extracting the plate 34 from the cassette 32. The plate 34 rides on a continuous plate guide 30, only a section of which is shown, into the elevator 14.

Figure 3:
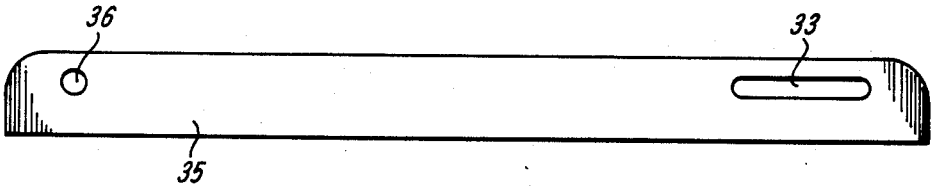
FIG. 3 is a top view of a side rail.
Figure 4:
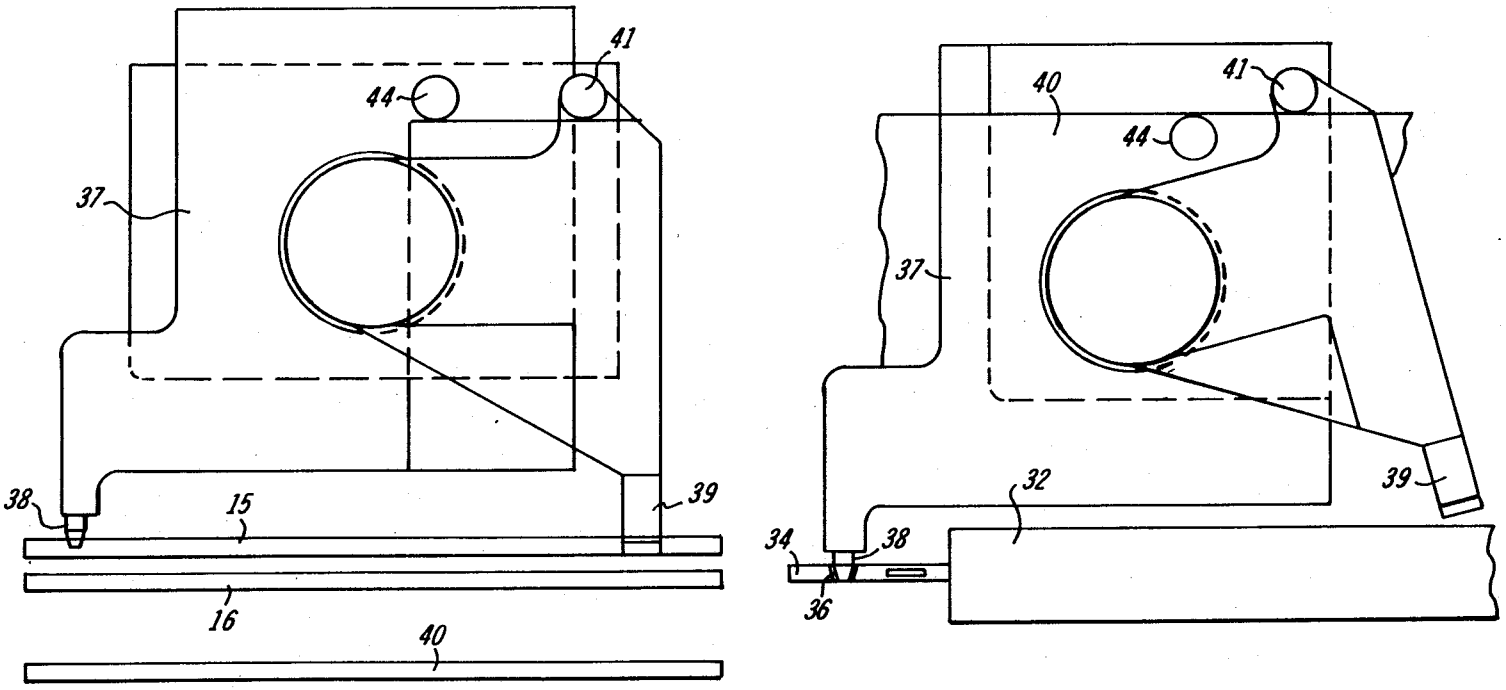

FIG. 3 is a top view of the right side rail of the plate, showing a slot 33 at the back end and a guide hole 36 at the front end. The apparatus which engages these slots and holes is shown in FIG. 4. There are two plate carriers shown in this figure. The one at the right is shown as it would be during initial engagement with the plate 34 just as it emerges from the cassette. The finger 38 of the carrier will drop into the guide hole 36 of the plate rail. The carrier and the plate will then proceed to the left on this drawing, driven by a chain drive. Eventually the cam follower 41 will reach the left end of the cam 40, at which time the cam will rotate clockwise a few degrees, allowing the rear finger 39 to fit into the slot 33 of the side rail 35. The carrier 37 then drives the plate 34 into the elevator 14 which is the left portion of the drawing. During this time, as shown as well in FIG. 1, the plate is on the lower track 40. The carrier in the left half of the drawing is shown as it would be positioned after passsing the cam 40. The main body of the carrier 37 rides roller 44.

Figure 5:
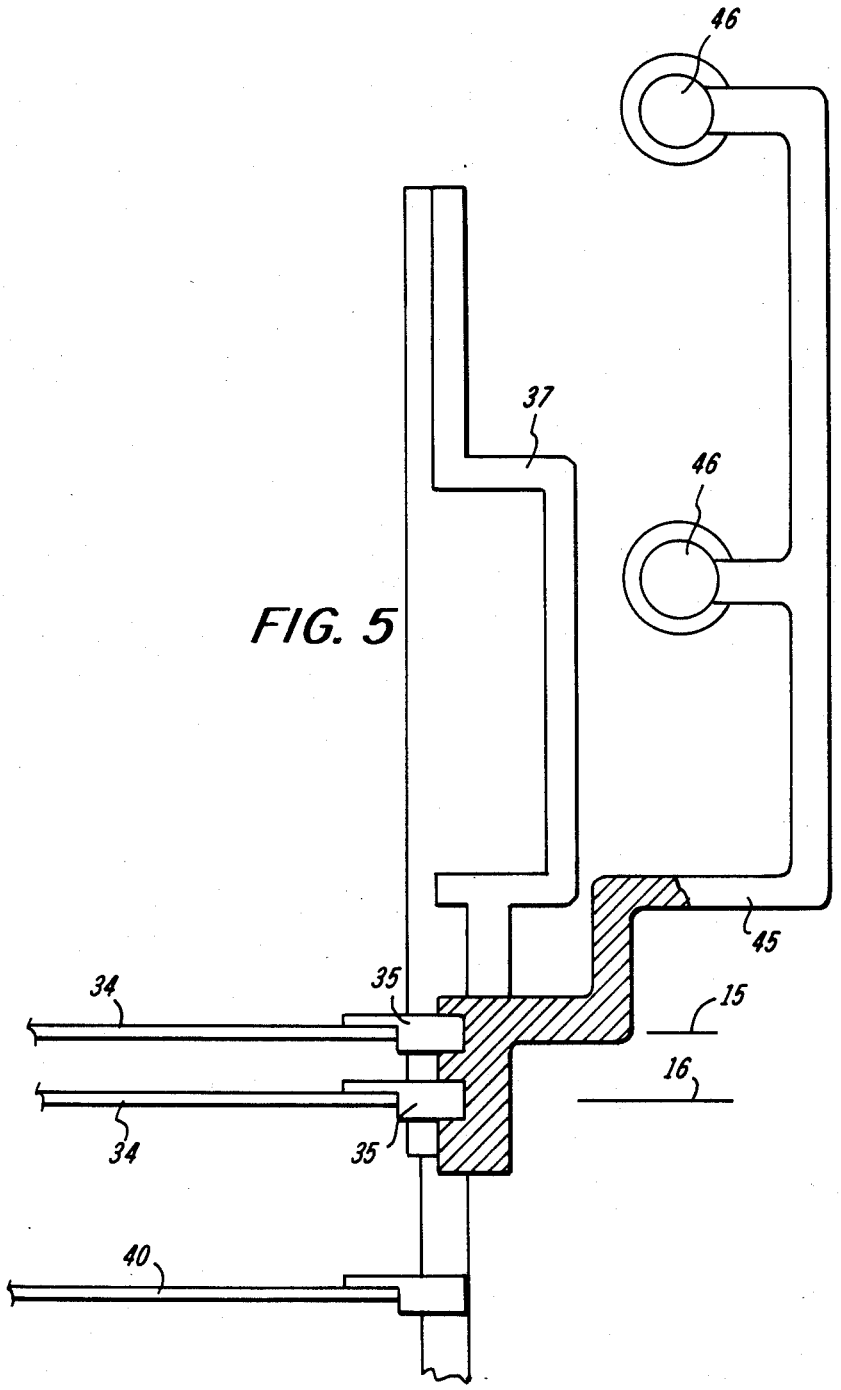
FIG. 5 is a side view of a plate carrier.

The side view of this mechanism, and including the carrier guide 45, is shown in FIG. 5. A plate 34, with its side rail 35, is shown in two positions, one on the upper track 15 level, the other on the development track 16. The lower track 40 is also shown in this figure. The plate carriers 37 ride on the carrier guide bearing surfaces 46. Here, as in all figures, the aluminum substrate of the plate is up, and the selenium coating is the lower surface of the plate.

Figure 6:
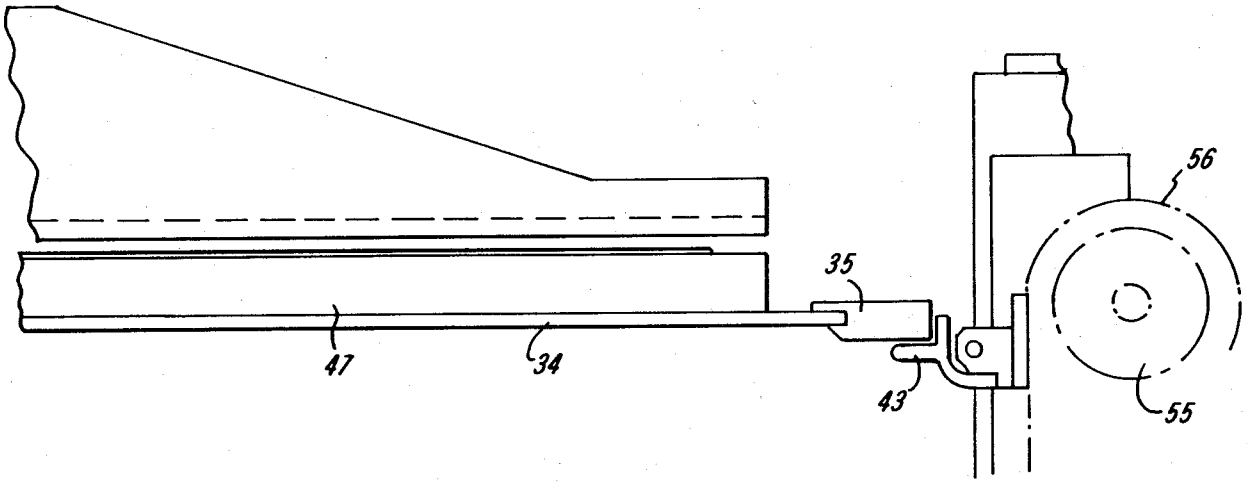
FIG. 6 is a front view of the elevator platform.

The plate is then raised to the upper track 15 on the elevator, which is shown in more detail in FIG. 6. The plate 34 and its side rails 35 are picked up by the elevator platform 43, which is raised or lowered by a chain drive, driven by motor 55. The plate is shown in the figure as positioned at the relaxation level of the elevator. In operation, the plate is raised into contact with the heating element 47 to remove residual images. The platform 43 is driven by motor 48 through chain drive 56.

The paper path, as seen in FIG. 1, is from the paper tray 28 located beneath the transfer station 19, around the section of a circular path 48 and across the transfer station 19 where it picks up the image. The paper, which is now wet in the places where liquid toner was deposited, is then dried at the drying station 21, and is then delivered to the operator at the output tray 22. The paper is pulled along this path by a chain driven gripper bar.

Figure 7:
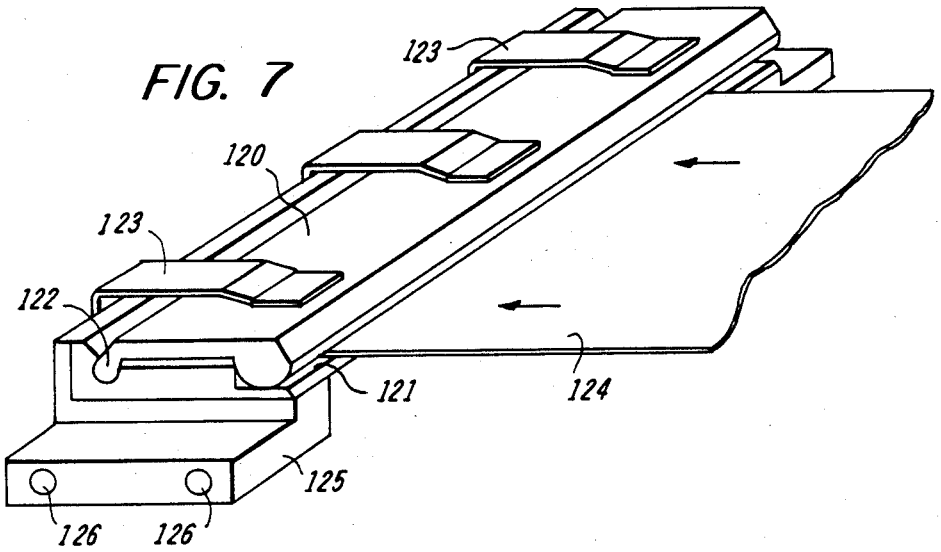
FIG. 7 is an overview of the gripper bar assembly.

FIG. 7 is an overall view of the gripper bar. The upper gripper 120 is captured during assembly in the groove at the rear of the lower gripper 121 to form a hinge at axis 122. Two or three spring clips 123 bias the two grippers into contact with the paper 124. An end block 125 is brazed onto the end of the lower gripper 121. The two holes 126 in the end block 125 allow the attachment of the gripper bar to the driving chain by two pins.

Figure 8:
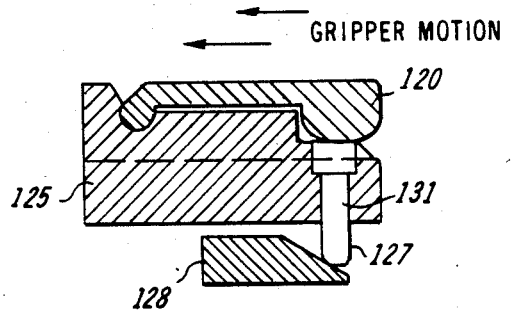
FIGS. 8 and 9 are cross sectional end views of the gripper bar showing the operation of the spring clips.
Figure 9:
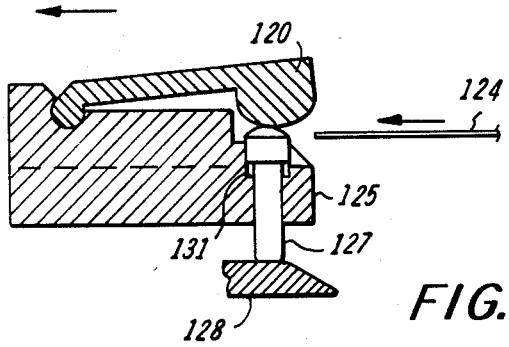

FIG. 8 shows the construction of the opening mechanism. A nylon pin 127 is captured in a hole drilled into the end block 125. The hole 131 has a larger diameter at the top, as does the pin 127. The pin is therefore captured by the end block 125 and the upper gripper 20. The end block 125 is pulled along the track from right to left over the stationary cam 128 which engges the pin 127 to open the gripper bar. FIG. 9 is the same view, but in the open position.

Figure 10:
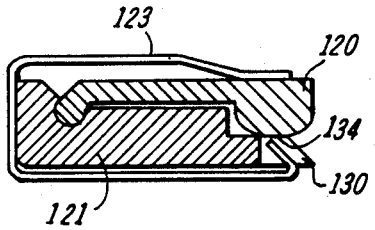
FIGS. 10 and 11 are cross sectional end views of the gripper bar showing the pin for opening the gripper bar.
Figure 11:
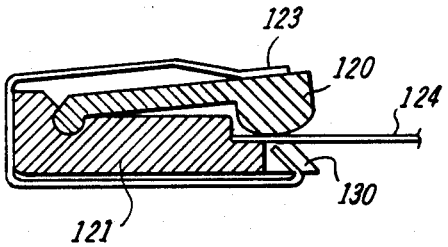

FIG. 10 is a cross sectional view showing the entire spring clip 123. The upper end of the clip is biased against the top of the upper gripper 120, and the lower end of the clip fits into a machined slot 130 in the lower gripper 121. The lower end of the clip 123 is bent upward and contacts the paper 124 between its end and the rounded portion of the upper gripper at contact point 134. FIG. 11 shows the gripper in a slightly open position, gripping a paper 124.

Figure 12:
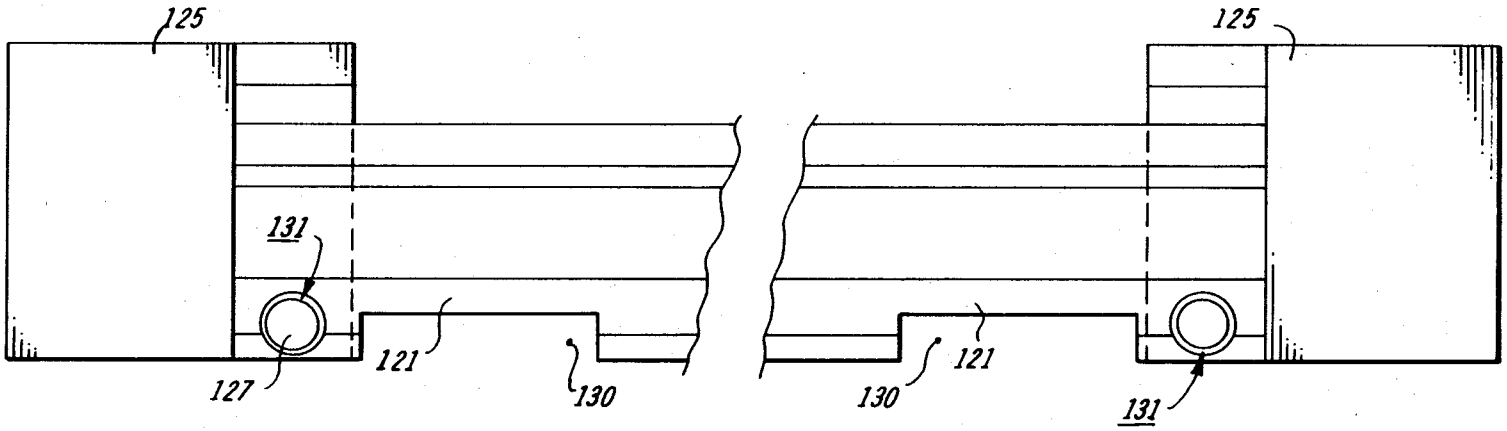

FIG. 12 is a top view of the lower gripper 121, in which the machined slot 130 has been cut. As can be seen from this view, the slot restrains the clip from moving to the right or left after assembly. Also shown in this view is the two diameters of the hole 131 in which the nylon pin 127 is contained. Finally, the end blocks 121 are brazed beneath the ends of the lower gripper 121 in the position shown.

Figure 13:
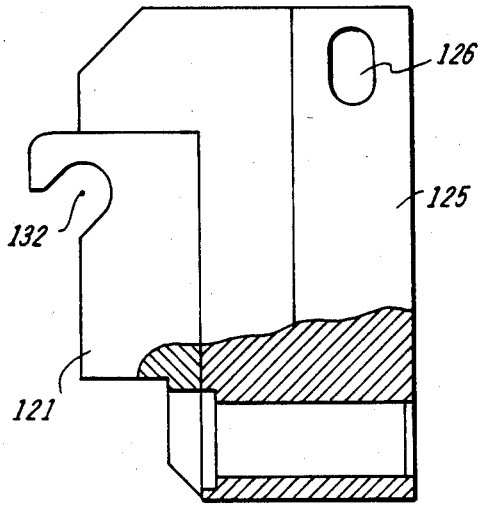
FIGS. 12 and 13 are views of the lower gripper.

FIG. 13 is an end view of FIG. 12. The groove 132 captures the rear portion of the upper gripper after assembly so that the upper and lower grippers effectively are rotatably joined together in a hinged relationship at this axis. One of the two holes 126 for the drive pins is shown. It actually is a slot since the pins are mounted on a chain, and the distance between pins is a bit shorter when the chain is traveling in an arc than it is when the chain portion is traveling along a straight section. Therefore, one hole is round to maintain position on the chain while the other is a slot to make up for the variation in distance.

Figure 15:
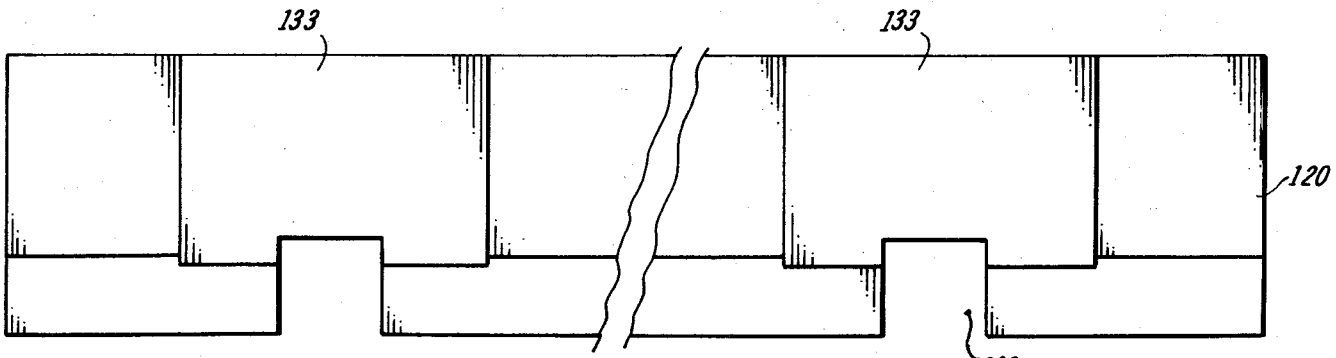
FIGS. 14 and 15 are views of the upper gripper.
Figure 14:
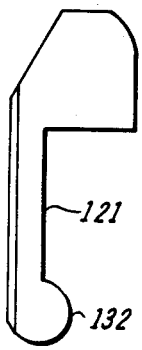

FIG. 14 is a cross section of the upper gripper 121. The rear portion 132 of this gripper is rounded to fit into the rear portion of the lower gripper. FIG. 15 is a top view of this upper gripper 120. There is a recessed portion 133 in the top of this upper gripper into which the top portion of the spring clip fits. The recess 133 is just deep enough to prevent the chip from sliding to the right or left.

Figure 16:
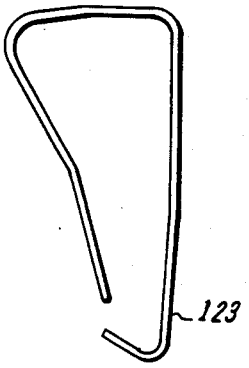
FIGS. 16 and 17 are views of the spring clips.
Figure 17:
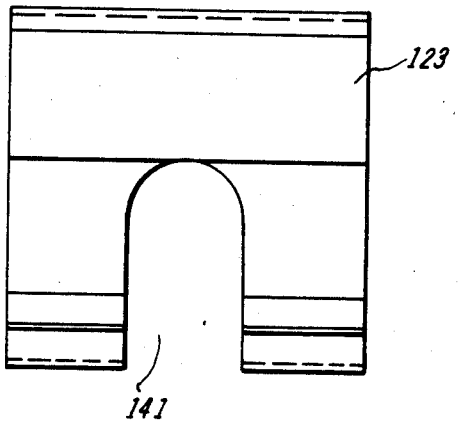

FIGS. 16 and 17 are side and bottom views of the stainless steel clip 123. In FIG. 17, the bottom of the clip is to the right. The bottom end is bent into a hook shape to engage the paper.

There are two slots 140 cut into the upper gripper 120 which line up with the slot 130 in the lower griper 121 and with the slot 141 in the bottom of the spring clip 123 to form a continuous opening through the gripper bar, from top to bottom, in two places. This opening can be used, in conjunction with a light beam and a light sensor, to detect the presence of a paper in the gripper bar. The slot 141 in the clip 123 also separates the bottom of the clip 123 into two separate spring loaded contacts for holding the paper.

While the invention has been described with reference to specific embodiments, it will be understood by those skilled in the art that various changes may be made and equivalents may be substituted for elements thereof without departing from the true spirit and scope of the invention. In addition, many modifications may be made without departing from the essential teachings of the invention.

I claim:

1. An automatic system for developing an image from a xerographic plate, which during exposure to x-rays and ambient light is enclosed in a cassette, comprising a development station, an image transfer station, a cleaning station, a changing station, input-output means, and an elevator having, from bottom to top, a stack of stored plates, a first, second, third and fourth level, the fourth level having a means for heating said plate to remove residual images, wherein the above mentioned components are situated within the system in the order stated from one end of the system to the other, said input-output means further comprising, from top to bottom, an input station into which the cassette containing an exposed plate is inserted, an output station from which is discharged a charged plate enclosed within a cassette, and an image output station where the finished image, on paper, is delivered to the operator, and further comprising means for transporting said plate through the system, which also has levels corresponding to those of the elevator, to the various stations in the following order; from the input station to the first level of the elevator, to the third level, to the other end of the system, to the second level, to the development station, to the transfer station, to the cleaning station, to the elevator, to the fourth level, and then onto the top of the stored stack of plates.

2. The system of claim 1 wherein the development station is moveable, and is driven in one direction while the plate passes over it in the other direction, thereby reducing the length of the system.

3. The system of claim 1 further comprising a paper tray and a means for transporting the paper from the paper tray, through the transfer station, to the image output tray.

4. The system of claim 1 further comprising means for transporting a plate from the bottom of the stack of plates stored in the bottom of the elevator over a means for charging the plate and into an empty cassette in the output station.

5. The system of claim 3 further comprising a sensor for detecting the absence of paper in the paper tray and means responsive to said sensor for preventing the removal of the plate from the cassette in the input station when there is no paper in the tray.

* * * * *